US008899709B2

(12) United States Patent
Govyadinov et al.

(10) Patent No.: US 8,899,709 B2
(45) Date of Patent: Dec. 2, 2014

(54) DETERMINING AN ISSUE WITH AN INKJET NOZZLE USING AN IMPEDANCE DIFFERENCE

(75) Inventors: Alexander Govyadinov, Corvallis, OR (US); Andrew L. Van Brocklin, Corvallis, OR (US); Eric T. Martin, Corvallis, OR (US); David Maxfield, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 112 days.

(21) Appl. No.: 13/450,620

(22) Filed: Apr. 19, 2012

(65) Prior Publication Data

US 2013/0278656 A1 Oct. 24, 2013

(51) Int. Cl.
*B41J 29/38* (2006.01)

(52) U.S. Cl.
USPC ..... 347/9; 347/14; 347/19; 347/101; 347/104

(58) Field of Classification Search
CPC ..... B41J 29/38
See application file for complete search history.

(56) References Cited

U.S. PATENT DOCUMENTS

| | | | | |
|---|---|---|---|---|
| 6,962,587 | B2 * | 11/2005 | Johnson et al. | 606/41 |
| 7,029,082 | B2 * | 4/2006 | Farr et al. | 347/7 |
| 7,735,945 | B1 * | 6/2010 | Sliwa et al. | 347/6 |
| 2002/0105555 | A1 * | 8/2002 | Tsukada et al. | 347/7 |
| 2004/0168514 | A1 * | 9/2004 | Tsukada et al. | 73/290 V |
| 2010/0033539 | A1 * | 2/2010 | Silverbrook et al. | 347/61 |
| 2011/0084997 | A1 * | 4/2011 | Chen et al. | 347/14 |

* cited by examiner

*Primary Examiner* — Manish S Shah
*Assistant Examiner* — Jeremy Delozier

(57) ABSTRACT

A method for determining an issue with an inkjet nozzle using an impedance difference includes taking a first impedance measurement with a sensor to detect a drive bubble in an ink chamber after a drive bubble formation mechanism is activated; and subtracting the first impedance measurement from a reference.

19 Claims, 8 Drawing Sheets

DETERMINING AN ISSUE WITH AN INKJET NOZZLE USING AN IMPEDANCE DIFFERENCE

BACKGROUND

In inkjet printing, ink droplets are released from an array of nozzles in a print head onto a printing medium, such as paper. The ink bonds to a surface of the printing medium and forms graphics, text, or other images. The ink droplets are released with precision to ensure that the image is accurately formed. Generally, the medium is conveyed under the print head while the droplets are selectively released. The medium's conveyance speed is factored into the droplet release timing.

Some inkjet printers include print heads that slide laterally across a swath, or width, of the printing medium during a print job. In such printers, the medium's conveyance is halted momentarily as the print head travels and releases the predetermined droplets along the swath of the medium. Other inkjet printers include print heads that remain stationary throughout a printing job. In these printers, an array of nozzles generally spans the entire swath of the printing medium.

Print heads typically include a number of ink chambers, also known as firing chambers. Each ink chamber is in fluid communication with one of the nozzles in the array and provides the ink to be deposited by that respective print head nozzle. Prior to a droplet release, the ink in the ink chamber is restrained from exiting the nozzle due to capillary forces and/or back-pressure acting on the ink within the nozzle passage. The meniscus, which is a surface of the ink that separates the liquid ink in the chamber from the atmosphere located below the nozzle, is held in place due to a balance of the internal pressure of the chamber, gravity, and the capillary force. The size of the nozzle passage is a contributing factor to the strength of the capillary forces. The internal pressure within the ink chamber is generally insufficient to exceed the strength of the capillary force, and thus, the ink is prevented from exiting the ink chamber through the nozzle passage without actively increasing the pressure within the chamber.

During a droplet release, ink within the ink chamber is forced out of the nozzle by actively increasing the pressure within the chamber. Some print heads use a resistive heater positioned within the chamber to evaporate a small amount of at least one component of the liquid ink. In many cases, a major component of the liquid ink is water, and the resistive heater evaporates the water. The evaporated ink component or components expand to form a gaseous drive bubble within the ink chamber. This expansion exceeds the restraining force enough to expel a single droplet out of the nozzle. Generally, after the release of single droplet, the pressure in the ink chamber drops below the strength of the restraining force and the remainder of the ink is retained within the chamber. Meanwhile, the drive bubble collapses and ink from a reservoir flows into the ink chamber replenishing the lost ink volume from the droplet release. This process is repeated each time the print head is instructed to fire.

BRIEF DESCRIPTION OF THE DRAWINGS

The accompanying drawings illustrate various examples of the principles described herein and are a part of the specification. The illustrated examples are merely examples and do not limit the scope of the claims.

DETAILED DESCRIPTION

As used herein, a drive bubble is a bubble formed from within an ink chamber to dispense a droplet of ink as part of a printing job or a servicing event. The drive bubble may be made of a vaporized ink separated from liquid ink by a bubble wall. The timing of the drive bubble formation may be dependent on the image to be formed on the printing medium.

The present specification describes principles including, for example, a method for determining an issue in an inkjet nozzle by detecting a drive bubble in an ink chamber associated with the inkjet nozzle. The issue may include a blockage of the nozzle, the presence of a stray bubble in the ink chamber, a blockage of an inlet into the ink chamber, a weak drive bubble formation, other issues, or combinations thereof. Examples of such a method include taking a first impedance measurement with a sensor to detect a drive bubble after a drive bubble formation mechanism is activated and subtracting the first impedance measurement from a reference. This differential measurement may be used to determine whether an issue exists and also determine the type of issue.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described is included in at least that one example, but not necessarily in other examples.

Figure 1:
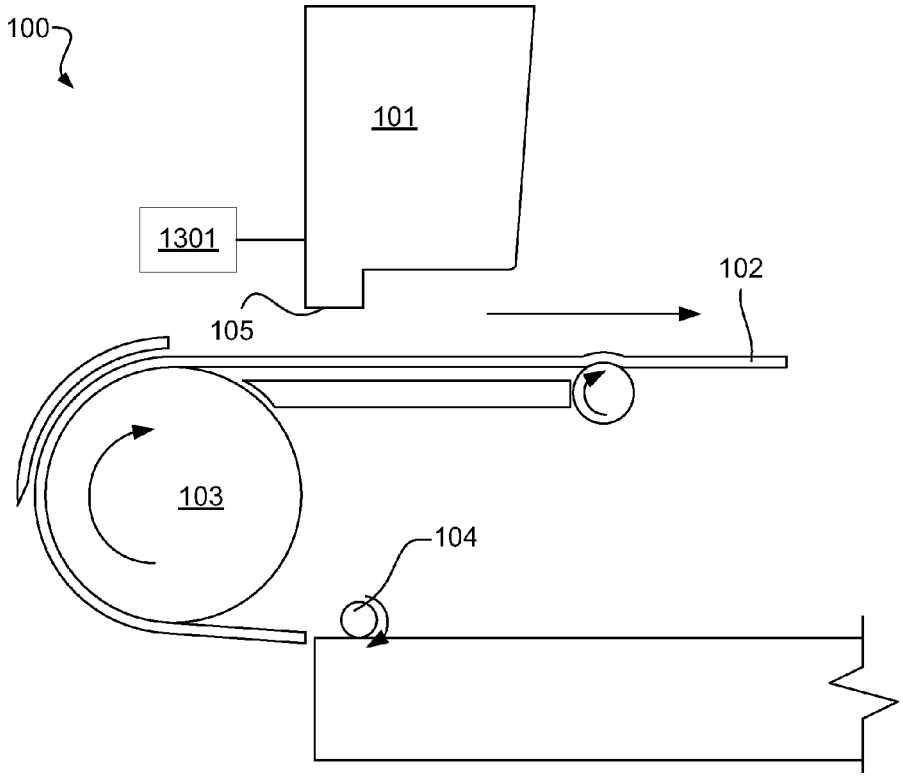
FIG. 1 is a diagram of illustrative components of a printer, according to principles described herein.

FIG. 1 is a diagram of illustrative components of a printer (100), according to principles described herein. In this example, the printer (100) includes a print head (101) positioned over a printing medium (102) traveling through the printer (100). The printer (100) further comprises a processor (1301) that is in communication with the print head (101) and is programmed to determine what issues the print head (101) is experiencing based, for example, on impedance measurements from the nozzles of the print head (101), as will be described in further detail below.

The printing medium (102) is pulled from a stack of media individually through the use of rollers (103, 104). In other examples, the printing medium is a continuous sheet or web. The printing medium may be, but is not limited to, paper, cardstock, poster board, vinyl, translucent graphics medium, other printing media, or combinations thereof.

The print head (101) may have a number of nozzles formed in its underside (105). Each nozzle may be in electrical communication with a processor that instructs the nozzles to fire at specific times by activating a heater within the ink chambers associated with each nozzle. The heater may be a heating element, resistive heater, a thin-film resistor, or other mechanism that may create a bubble within the ink chamber. In other examples, a piezo-electric element may create pressure in the ink chamber to file a desired nozzle.

Figure 2:
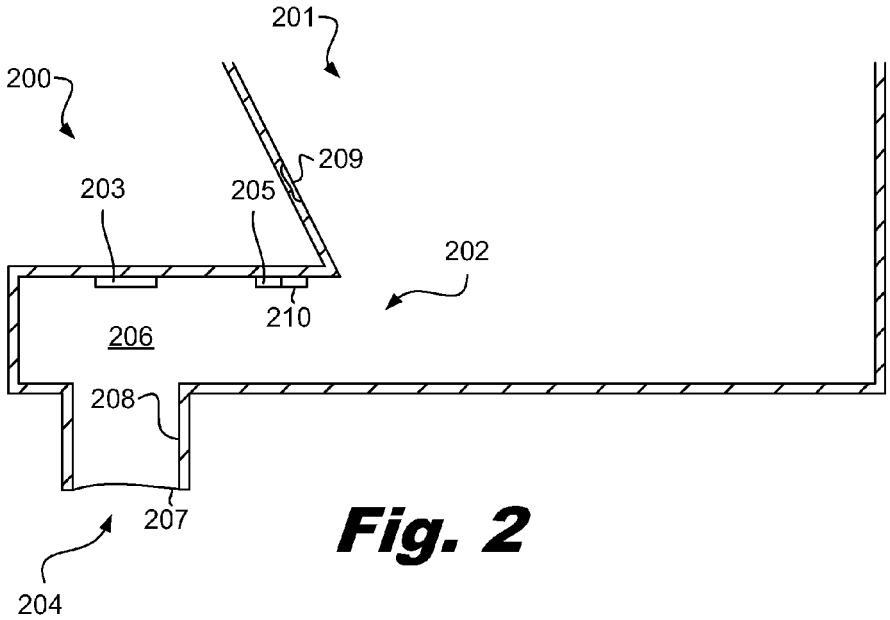
FIG. 2 is a cross sectional diagram of an illustrative ink chamber, according to principles described herein.

FIG. 2 is a cross sectional diagram of an illustrative ink chamber (200), according to principles described herein. In this example, the ink chamber (200) is connected to an ink reservoir (201) through an inlet (202). A heater (203) is positioned over the nozzle (204). A first impedance sensor (205) and a second impedance sensor (210) are positioned near the heater (203). Capillary forces cause the ink to form a meniscus (207) within a passage (208) of the nozzle (204). The meniscus is a barrier between the liquid ink (206) in the chamber (200) and the atmosphere located below the nozzle (204). The internal pressure within the ink chamber (200) is not sufficient to move ink out of the chamber (200) unless the chamber's internal pressure is actively increased.

The impedance sensor (205) may have a plate made of a material of a predetermined resistance, such as a metal. In some examples, the metal plate is made of tantalum, copper, nickel, titanium, or combinations thereof. In some examples, the metal is capable withstanding corrosion due to the metal's contact with the liquid ink (206). A ground element (209) may also be located anywhere within the ink chamber (200) or ink reservoir (201). In the example of FIG. 2, the ground element (209) is depicted in the ink reservoir (201). In some examples, the ground element is an etched portion of a wall with a grounded, electrically conductive material exposed. In other examples, the ground element (209) may be a grounded electrical pad. When, in the presence of liquid ink (206), a voltage is applied to the impedance sensor (205), an electrical current may pass from the impedance sensor (205) to the ground element (209).

The liquid ink (206) may be more conductive than the air or other gasses in the drive bubble. In examples where the liquid ink contains some partly aqueous vehicle mobile ions, and a portion of the sensor's surface area is in contact with the liquid ink (206) when a current pulse or voltage pulse is applied to the sensor (205), the sensor's impedance is lower than it would otherwise be without the ink's contact. On the other hand, when an increasingly larger amount of the sensor's surface area is in contact with the gases of a drive bubble and a voltage or current of the same strength is applied to the sensor (205), the sensor's impedance increases. The sensor (205) may be used to make a measurement of some component of impedance, such as the resistive (real) components at a frequency range determined by the type of voltage source supplying the voltage or current to the sensor. In some examples, a cross sectional geometry of the drive bubble or stray bubbles along the electrical path between the impedance sensor (205) and the ground element (209) may also affect the impedance value.

FIGS. 3-6 depict an illustrative inkjet nozzle with a healthy condition during an ink droplet release. A healthy inkjet nozzle is a nozzle that is associated with an ink chamber, heater, and other components that are free of issues that would cause the nozzle to fire improperly. An improperly firing nozzle includes a nozzle that fails to fire at all, fires early, fires late, releases too much ink, releases too little ink, or combinations thereof.

FIGS. 3-6 depict the stages of the drive bubble from its formation to its collapse. These depictions are merely illustrative. Bubble size and geometry are determined by the factors such as an amount of heat generated by the heater, the internal pressure of the ink chamber, the amount of ink in the ink reservoir, the viscosity of the liquid ink, the ion concentration of the ink, the geometry of the ink chamber, volume of the ink chamber, the diameter size of the nozzle passage, the position of the heater, other factors, or combinations thereof.

Figure 3:
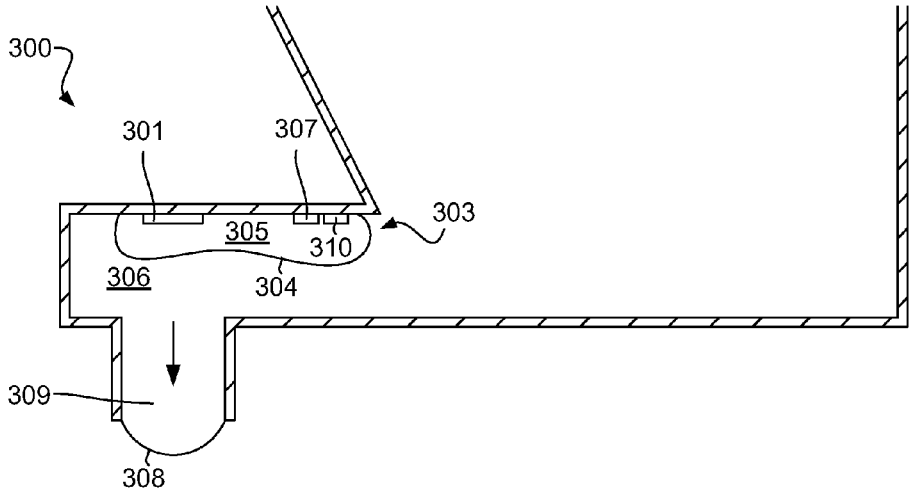
FIG. 3 is a cross sectional diagram of an illustrative ink chamber, according to principles described herein.

FIG. 3 is a cross sectional diagram of an illustrative ink chamber (300), according to principles described herein. In FIG. 3, a heater (301) in the ink chamber (300) is initiating drive bubble formation. A voltage is applied to the heater (301), and the heater's material resists the associated current flow driven by the voltage resulting in Joule heating. This heats the heater's material to a temperature sufficient to evaporate liquid ink in contact with the heater (301). As the ink evaporates, the ink in gaseous form expands forming a drive bubble (303). A bubble wall (304) separates the bubble's gas (305) from the liquid ink (306). In FIG. 3, the drive bubble (303) has expanded to such a volume that the heater (301) and the sensor (307) make physical contact just with the bubble's gas (305). Since the sensor is in contact with the bubble's gas (305), the sensor (307) measures an impedance value that indicates the drive bubble (303) is in contact with the sensor (307).

The expansion of the drive bubble (303) increases the internal pressure of the ink chamber (300). During the stage depicted in the example of FIG. 3, the chamber's internal pressure displaces enough ink to force the meniscus (308) within the nozzle's passage (309) to bow outward. However, at this stage, inertia continues to keep all of the liquid ink (306) together.

Figure 4:
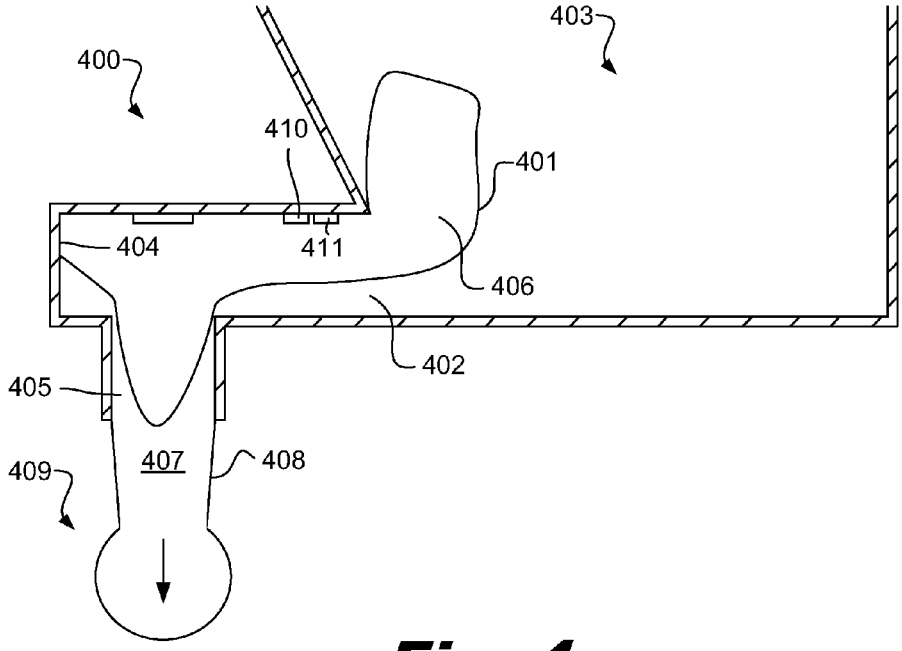
FIG. 4 is a cross sectional diagram of an illustrative ink chamber, according to principles described herein.

FIG. 4 is a cross sectional diagram of an illustrative ink chamber (400), according to principles described herein. In this figure, more time has passed from the initiation of the drive bubble, and the drive bubble's volume has continued to increase. At this stage, the drive bubble wall (401) extends through a chamber inlet (402) into an ink reservoir (403). On the other side of the chamber, the bubble wall (401) makes contact with the chamber's far wall (404). Another portion of the bubble wall (401) enters into the nozzle passage (405).

The drive bubble (406) may substantially isolate the liquid ink (407) in the chamber passage (405) from the rest of the ink chamber (400). As the drive bubble (406) continues to expand into the nozzle passage (405), the pressure in the nozzle passage (405) increases to such a degree that the liquid ink (407) in the passage (405) pushes the meniscus (408) out of the nozzle passage (405) increasing the meniscus's surface area. As the meniscus (408) increases in size, a droplet (409) forms that pulls away from the passage (405).

At this stage, the drive bubble (406) continues to cover the entire surface area of the sensors (410, 411). Thus, the sensors (410, 411) may measure the drive bubble's presence by measuring a higher resistance or impedance that the sensors (410, 411) would otherwise measure if they were in contact with liquid ink (407).

Figure 5:
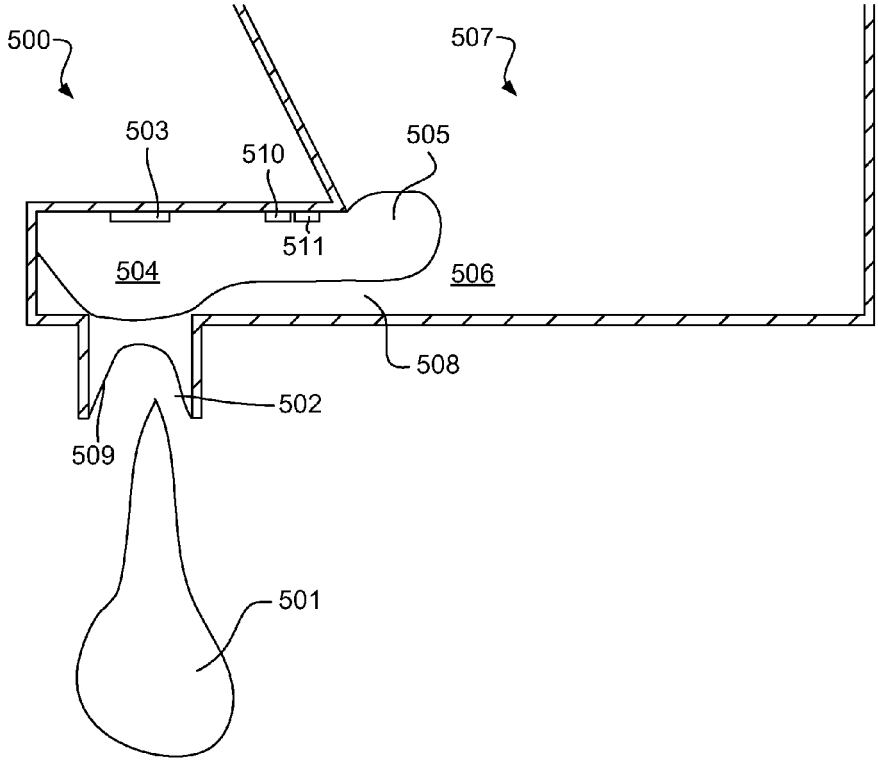
FIG. 5 is a cross sectional diagram of an illustrative ink chamber, according to principles described herein.

FIG. 5 is a cross sectional diagram of an illustrative ink chamber (500), according to principles described herein. In this example, the ink droplet (501) is breaking free from the nozzle passage (502).

At this stage, the gas (504) of the drive bubble (505) cools in the absence of the heat from the heater (503). As the gas (504) cools, the drive bubble (505) shrinks, which depressurizes the ink chamber (500). The depressurization pulls liquid ink (506) from the ink reservoir (507) into chamber (500) through the chamber inlet (508) to replenish the ink volume lost to the droplet release. Also, the meniscus (509) is pulled back into nozzle passage (502) due to the depressurization. The sensor (510) continues to measure a comparatively high impedance value because the drive bubble (505) continues to isolate the sensor (510) from the liquid ink (506).

Figure 6:
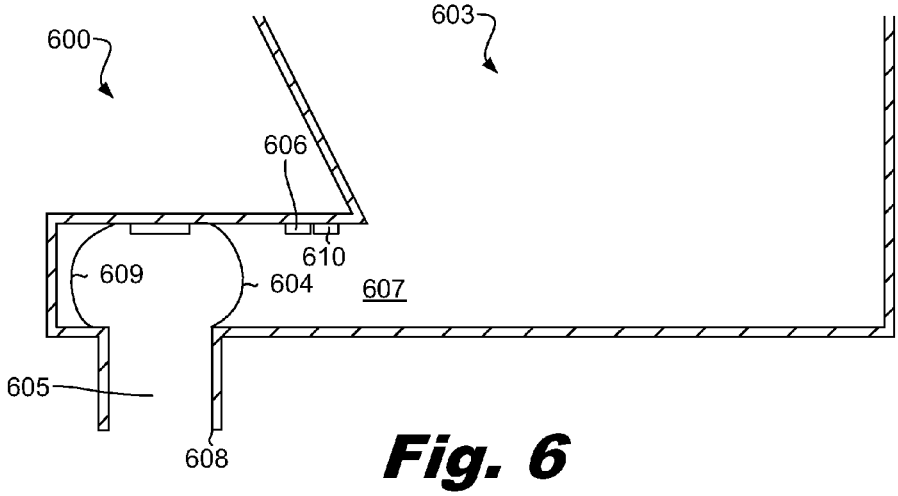
FIG. 6 is a cross sectional diagram of an illustrative ink chamber, according to principles described herein.

FIG. 6 is a cross sectional diagram of an illustrative ink chamber (600), according to principles described herein. In this figure, the drive bubble merges with the meniscus. As the internal pressure of the ink chamber (600) increases due to the ink flow from the reservoir (603), the bubble wall (604) is forced back towards the nozzle passage (605). During this bubble wall retraction, the reservoir side bubble wall (604) pulls away from the sensor (606). As the sensor (606) reestablishes contact with the liquid ink (607), the sensor measures a lower impedance value due to the higher electrical conductivity of the liquid ink (607).

At this stage under healthy operating conditions, the reservoir side bubble wall (604) resists a greater amount of pressure than the far bubble wall (609) due to the ink flow from the ink reservoir (603) reestablishing a pressure equilibrium in the ink chamber (600). The ink flow replenishes the lost ink volume, and the meniscus moves to the end (608) of the nozzle passage (605).

Again, FIGS. 3-6 depict an example of an illustrative inkjet nozzle with a healthy condition during an ink droplet release. However, many conditions may adversely affect the droplet release. For example, a blockage of the nozzle passage may prevent the formation of an ink droplet. The measurement results when a nozzle is blocked in this way may show that the drive bubble forms normally, but that the drive bubble collapses more slowly than expected.

In other examples, a blockage of the ink chamber inlet may prevent ink from flowing from the ink reservoir to reestablish equilibrium within the ink chamber. In such a situation, the liquid ink may fail to come back into contact with the sensor. In other cases, the ink never enters the chamber during the priming process.

Blockages in either the inlet or nozzle passage may occur due to particles in the ink or solidified portions of the ink. The ink may solidify from exposure to air in the nozzle passage or from heating from the heater. Generally, ink chambers have a volume in the picoliter scale, thus, very small particles may partially or completely form blockages within the ink chamber.

In some cases, liquid ink may dry and solidify on the heater and become a thermal barrier that inhibits the heater's ability to vaporize the liquid ink. The thermal barrier may completely hinder the heater's ability to form a drive bubble or limit the heater to forming a smaller, weaker drive bubble than desired.

Also, the presence of a stray bubble may affect the ink droplet release. Since droplet release timing effects the accuracy of the image formed on the printing medium, the latency from initiating the drive bubble formation to the actual droplet release needs to be predictable. Sometimes air bubbles form in either the body of the ink in the ink reservoir or in the chamber itself due to air or other gasses out-gassing from the ink. In some cases, this causes a semi-permanent stray bubble of gas to be created in or migrate towards the inkjet chamber. Such a stray bubble may reside in the ink chamber. The presence of these stray bubbles within the ink chamber may affect the overall compressive condition of the ink. For example, the mechanical compliance of a stray bubble may absorb some of the internal pressure intended to displace ink out of the nozzle passage and delay the droplet release. Further, a stray bubble's wall may deflect the drive bubble away from the nozzle passage in such a manner that the droplet fails to form or forms more slowly.

In some examples, the ink flow from the reservoir may fail to establish an equilibrium near the chamber's far wall and allow a residual bubble to remain in the ink chamber after the drive bubble has collapsed. In other examples, the ink may become frothy resulting in the formation of a plurality of miniature air bubbles in the liquid ink. The froth may be formed due to an air leak into the reservoir, a contaminant in the ink, an unintended mechanical agitation that mixes air from the nozzle passageway with the ink in the chamber, another mechanism, or combinations thereof. The froth may also be formed from a hurtful prime, which is a failed priming process that allows air to leak into the chamber as bubbles.

Due to the variety of effects that stray bubbles may have on a nozzle's health, the sensor may make inconsistent measurements. For example, frothy ink may measure as having a higher impedance value while in contact with the liquid ink due to some contact with the small air bubbles. In situations where a larger stray bubble is present, the liquid ink may fail to rewet the sensor's plate.

As will be explained in more detail below, these various issues will have differentiating characteristics as measured by the sensor (e.g. 205 in FIG. 2) in the ink chamber. For example, the life span of a drive bubble as measured by the sensor can indicate which, if any, of these various issues is occurring. Consequently, the output from that sensor can be used to determine which of the various issues described is occurring in a particular nozzle of the print head.

Figure 7:
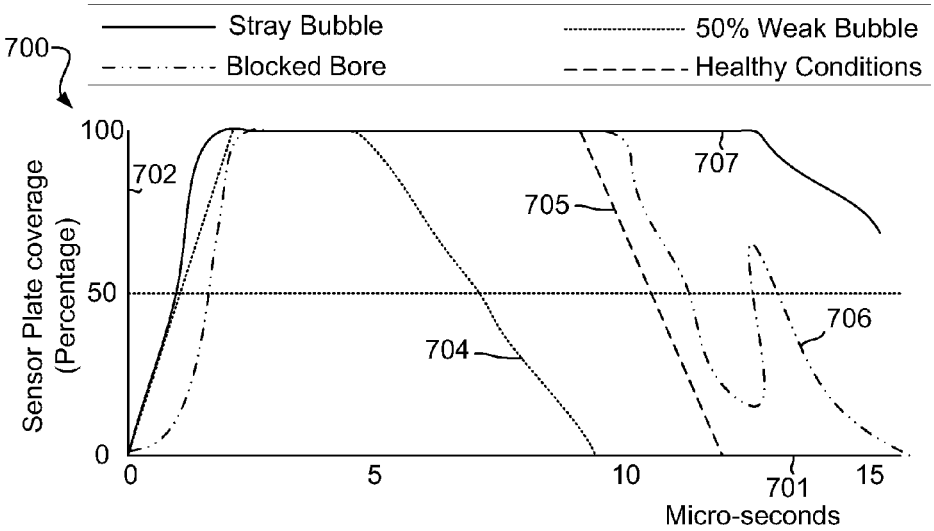
FIG. 7 is a diagram of an illustrative chart showing bubble life spans, according to principles described herein.

FIG. 7 is an illustrative chart (700) showing bubble life spans per type of nozzle health issue as measured from a sensor within the ink chamber, according to principles described herein. In this example, the x-axis (701) schematically represents time in microseconds. Zero microseconds may correspond to the initiation of the drive bubble formation. The y-axis (702) may schematically represent the drive bubble's coverage of the sensor plate's surface area, which corresponds to the real portion of the impedance measurement.

The drive bubble's coverage depicted on the y-axis (702) may correspond to the impedance measurement taken by the sensor in the ink chamber over time. For example, a minimum impedance measurement may indicate that the entire surface area of the sensor is in contact with the ink and may correspond to zero percent surface area coverage on the y-axis (702). On the other hand, a maximum impedance measurement may indicate that the entire surface area of the sensor is in contact with the drive bubble and may correspond to a hundred percent surface area coverage on the y-axis (702). Impedance measurements between the minimum and maximum may indicate that a portion of the sensor's surface area is covered with liquid ink and another portion is covered by the drive bubble. In some examples, a higher impedance measurement indicates that a greater portion of the surface area is covered by the drive bubble. On the other hand, a lower impedance measurement may indicate that a majority of the surface area is a covered by liquid ink.

A legend (703) indicates which lines (704, 705, 706, 707) are associated with specific nozzle conditions, such as a healthy condition, a weak bubble, a blocked nozzle passage, and the presence of a stray bubble. The values of the chart (700) in the example of FIG. 7 may be experimentally determined prior to a print job and may be specific to ink chambers of like geometry, size, other characteristics, and combinations thereof.

Figure 8:
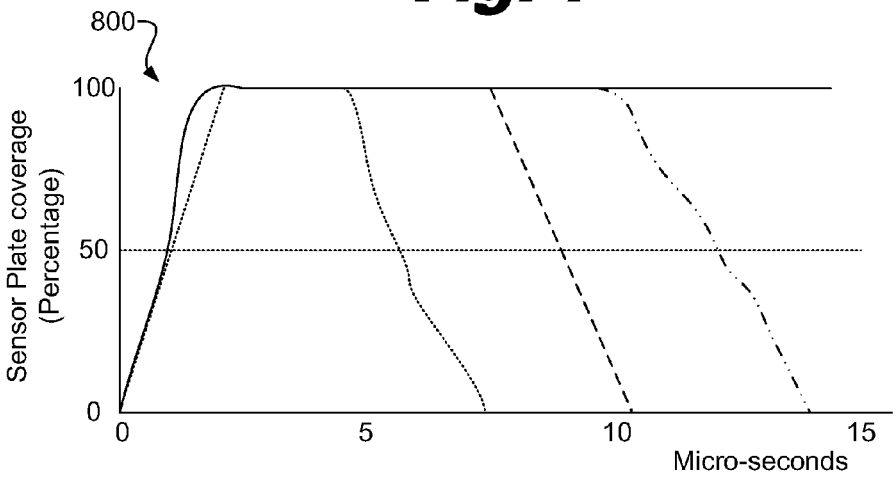
FIG. 8 is a diagram of an illustrative chart showing drive bubble life spans, according to principles described herein.

FIG. 8 is a diagram of an illustrative chart (800) showing drive bubble life spans measured from a sensor, according to principles described herein. In the example of FIG. 8, the sensor taking the measurements may be a different sensor located in at a different position than the sensor that took measurements in the example of FIG. 7. The measurements in the examples of FIGS. 7 and 8 may be taken at the same time. In other examples, the measurements are taken at different times.

Figure 9:
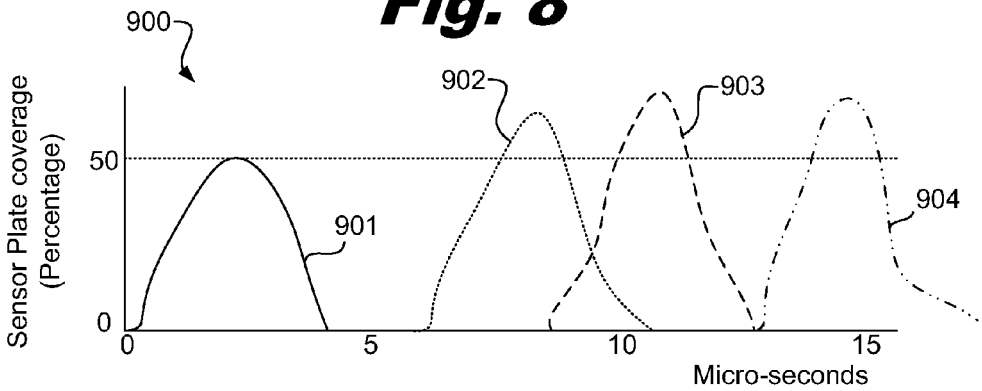
FIG. 9 is a diagram of an illustrative chart showing differential measurements, according to principles described herein.

FIG. 9 is a diagram of an illustrative chart (900) showing differential measurements, according to principles described herein. In the example of FIG. 9, the chart includes the measurements of a first sensor in a first position subtracted from the measurements of a second sensor located in a second position. In this manner, a unique, differential profile of the bubbles are formed. Each line (901, 902, 903, 904) forms a spike at the greatest difference between the measurements of the different sensors. These differences may be used to identity issues with the nozzle. For example, a processor may command that a measurement from both the first and the second sensor be taken between two and three microseconds. The difference between the two measurements may be determined, if any. In cases where a differential value found, then processor may conclude that the nozzle has a stray bubble. If there is no difference between the measurements, then the processor may determine that the nozzle has some other condition.

The processor may instruct that a measurement be taken between eight and nine microseconds to determine whether a weak drive bubble was formed. Further, the processor may command that a measurement be taken between eleven and twelve microseconds to determine if the nozzle is performing normally. Also, the processor may command that a measurement be taken between fourteen and fifteen microseconds to determine if nozzle has a blocked nozzle passage.

In this manner, the processor may accurately determine the condition of the nozzle with measurements taken at a single time. Further, in the example of FIG. 9, the lines (901, 902, 903, 904) have a minimal overlap, and consequently, the false determinations are harder to make allowing a processor to make determinations confidently.

In some examples, the sensor takes the first and second measurements at substantially the same time during a print job to determine whether the sensor is in contact with liquid ink or the drive bubble.

Upon indication that there is an unhealthy nozzle condition, a processor may determine to make a remedial action. For example, the processor may determine to increase the energy applied to the heater to compensate for a weak bubble formation. Also, the processor may determine to inactivate the nozzle, send an issue notification, compensate for the nozzle's condition by instructing another nozzle to perform the unhealthy nozzle's job, initiate other remedial actions, or combinations thereof.

In some examples, circuitry converts the differentials into binary data. For example, a "1" may represent a differential measurement while a "0" may represent a lack of a differential measurement or no differential measurement. In this manner, the differential may simplify signal processing.

Figure 10:
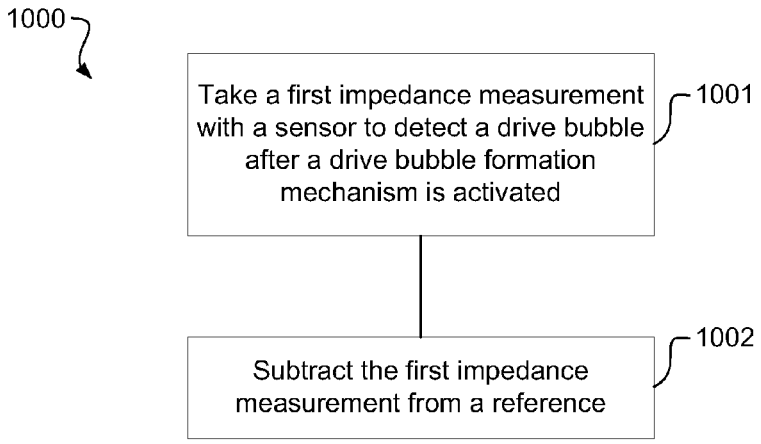
FIG. 10 is a diagram of an illustrative method for determining an issue with an inkjet nozzle, according to principles described herein.

FIG. 10 is a diagram of an illustrative method (1000) for determining an issue in an inkjet nozzle, according to principles described herein. In this example, the method (1000) includes taking (1001) a first impedance measurement with a sensor to detect a drive bubble after a drive bubble formation mechanism is activated and subtracting (1002) the first impedance measurement from a reference.

In some examples, the difference between the first and second measurements is used to determine whether an issue exists. In some examples, the difference is used to determine the type of issue as well. The issue that the method may determine may be a blockage of the nozzle, a formation of a weak bubble, a presence of a stray bubble, a blockage of a chamber inlet, other issue, or combinations thereof.

In some examples, the reference is an impedance value stored in memory. The impedance value may be derived from an earlier measurement taken in the ink chamber or a measurement taken of a similar ink chamber. The impedance value may be downloaded into the memory prior to or after taking the first measurement. The impedance value may be another impedance value taken at substantially the same time lapse as the method's first impedance measurement from the activation of the drive bubble formation mechanism.

In some examples, the reference is derived from a second measurement that is taken at substantially the same time as the first measurement. The second measurement may be of the same ink chamber or an adjacent ink reservoir. In other examples, the second measurement may be taken with a second sensor to detect a second drive bubble in a second ink chamber.

In some examples, multiple measurements are taken at substantially the same time. In such examples, at least two of the measurements may be subtracted from the reference yielding a first and a second difference. The multiple differences may be used collectively to determine the issue. In some examples, one of the multiple differences is used. In some examples, one of the multiple differences is used to ensure that the sensor circuitry is working properly.

The method may be employed on an actual printing job. In this manner, issues may be detected in real time and avoid wasting time and resources if an issue develops during a printing job. Also, the method may take just a few microseconds to perform and may be repeated often without interfering with the printing process. Further, multiple nozzle may be diagnosed during the print job. Additionally, the method may seem transparent to a user of the printer.

Further, the method may be employed during a servicing event as well. A servicing event may take place during, before, or after a printing job. To prevent liquid ink from drying in and around the nozzle passage, the nozzle may be fired into a service station. In examples where the print head scans across the printing medium's swath, the service station may be located to the side of the swath. The print head may dock at the printing station during a printing job as needed and/or the print head may dock at the service station when the print head is not in use. While docked, the print head may fire a single nozzle at a time to determine a health issue with that nozzle. By firing a single nozzle at a time, misreads from other nozzles being evaluated at the same time may be reduced. In some examples, some or all of the nozzles may be fired in a particular sequence to control the spacing and reduce interference with the diagnosis of other nozzles. In examples, where the print head remains stationary with respect to the swath of the printing medium, a service station may move to the print head for servicing as needed.

The method may also include initiating a remedial action with a processor in response to an issue. The remedial response may include using a second inkjet nozzle to compensate for the issue. In some examples, more than one additional nozzle may be used to compensate for the issue. In examples where the print head slides across the swath of the printing medium, the compensating nozzle or nozzles may be located on any portion of the print head. In examples where an array of nozzles is stationary with respect to the swath of the printing medium, the compensating nozzles may be located before or after the nozzle along a pathway traveled by the printing medium. In some examples, the compensating nozzle is a back-up nozzle intended for use when a nozzle has an issue. In alternative examples, the compensating nozzle is already operating and picks up additional tasks for the unhealthy nozzle in addition to the tasks already assigned to the compensating nozzle.

Another remedial action may include sending a notification about the issue. The notification may be sent to a printer operator, a maintenance service provider, a data base, a remote location, or combinations thereof. The nozzle may be disabled until the nozzle receives remedial attention. In some examples, the processor determines if the nozzle is still capable of functioning for a time despite having an issue. The processor may determine to take no action or wait to make a remedial action.

In some examples, the printer already has built in mechanisms and/or procedures to deal with blocked nozzles, stray bubbles, weak bubble formations, blocked inlets, other issues, or combinations thereof. These built-in mechanisms may be performed automatically by the printer or print head without the assistance of a printer user or repair person.

Figure 11:
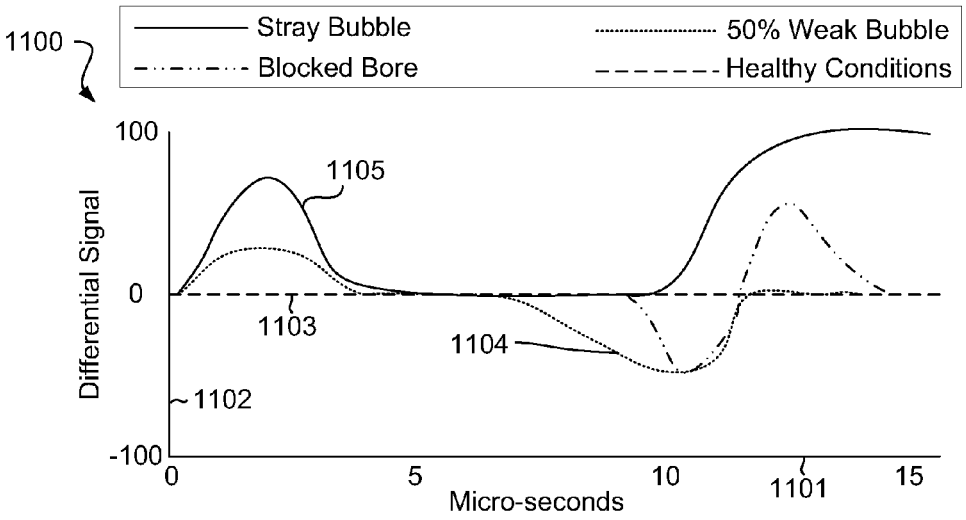
FIG. 11 is a diagram of an illustrative chart showing differential measurements, according to principles described herein.

FIG. 11 is a diagram of an illustrative chart (1100) showing differential measurements, according to principles described herein. In this example, the x-axis (1101) schematically represents time in microseconds. The y-axis (1102) represents a differential signal from a healthy condition schematically represented by line (1103) at zero. For example, from one to three microseconds, a weak bubble and a stray bubble both measure a higher impedance value than would be measured under healthy conditions, so the lines (1104, 1105) that schematically represent a weak bubble and a stray bubble respectively are above line (1103). Similarly, between seven and twelve microseconds a weak bubble would measure a lower impedance than would be measured under healthy conditions, so the line (1104) that represents a weak bubble is beneath line (1103).

When a measurement is taken during the life span of a bubble, and the differential signal is positive or negative with respect to healthy conditions, a processor may determine that there is an issue with the nozzle. Depending on the time that the measurement is taken, the processor may also determine what type of issue exists. In some examples, measurements are taken at multiple times to determine the issue type.

In some examples, the differential signals are normalized around another condition other than a healthy condition. For example, a blocked nozzle may have a consistent span life and may be normalized to zero as the healthy condition is normalized to zero in the example of FIG. 11.

Figure 12:
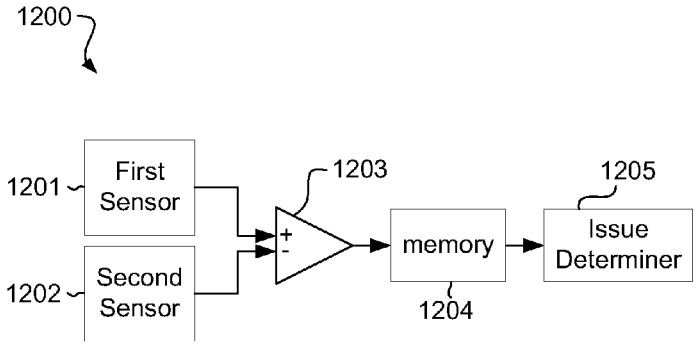
FIG. 12 is a diagram of illustrative circuitry for determining an issue, according to principles described herein.

FIG. 12 is a diagram of illustrative circuitry (1200) for determining an issue with an inkjet nozzle, according to principles described herein. In this example, the circuitry (1200) includes at least a first sensor (1201) and a second sensor (1202). The first and the second sensors (1201, 1202) may be positioned to detect the presence of the same drive bubble. In some examples, the first and the second sensors (1201, 1202) are positioned to detect different drive bubbles in different ink chambers. The measurements from the first and the second sensors (1201, 1202) are directed to a circuit element that can determine the difference between the measurements. In the example of FIG. 12, the circuit element is a differential amplifier (1203).

The difference is then compared to a look-up table stored in memory (1204) that contains a list of the value differences per time after the drive bubble formation mechanism is activated. The memory may be flash memory, dynamic random access memory, static random access memory, memristor memory, or combinations thereof. The results of the comparison between the look-up table and the differences are sent to an issue determiner (1205), which determines if there is an issue with the nozzle. In some examples, if there is an issue, the issue determiner (1205) also determines the kind of issue, such as a blocked nozzle, blocked inlet, weak bubble formation, presence of a stray bubble, other issue, or combinations thereof.

Figure 13:
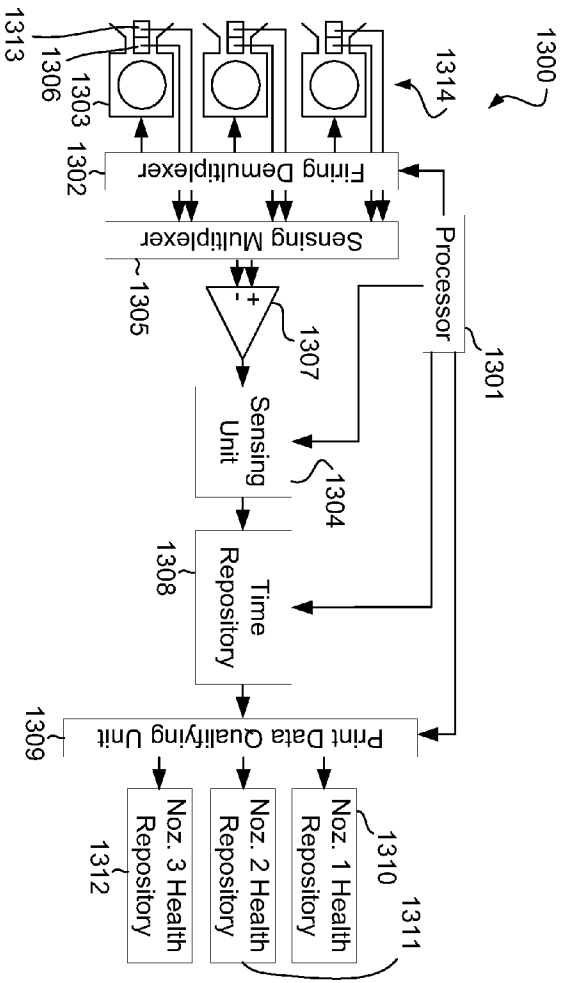
FIG. 13 is a diagram of illustrative circuitry for determining an issue, according to principles described herein.

FIG. 13 is a diagram of illustrative circuitry (1300) determining an issue, according to principles described herein. A processor (1301) may control the timing for both firing nozzles and taking measurements within their associated ink chambers. In the example of FIG. 13, a processor (1301) is in communication with a firing demultiplexer (1302), which directs a firing command from the processor (1301) to the predetermined nozzle (1303). When the predetermined nozzle (1303) receives the firing command, the drive bubble formation mechanism, such as a heater, initiates the formation of a drive bubble in the ink chamber.

The processor (1301) may also send a measurement command to the predetermined nozzle (1303) to take a measurement with the first sensor (1306) and the second sensor (1313) positioned to detect the presence of the drive bubble in the ink chamber after the firing command is sent. In some examples, the measurement commands are sent between five and thirty five seconds after the firing command is sent.

In some examples, an amplifier is included in the circuitry (1300) to amplify the measurement signal. Also, a digital to analog converter may convert the measurement commands into analog signals for taking measurements, and an analog to digital converter may convert the measured signals back into digital signals for processing.

The measurement taken in response to the measurement command may be sent to a sensing multiplexer (1305) that routes the measurements to a differential amplifier (1307) or other circuit element to determine the difference between the first and the second measurements.

In the example of FIG. 13, the difference is sent to a sensing unit (1304) to interpret the difference. The sensing unit (1304) may be in communication with a time repository (1308) that contains information about what measurement differences would be in each nozzle at specific times after a firing event. For example, the time repository (1308) may include a look-up table that indicates that if the drive bubble is a weak bubble with fifty percent strength, then the differential would have a peak impedance differential value at eight microseconds.

The information from the time repository (1308) may be sent to a print data qualifying unit (1309) that is in communication with the processor (1301) that instructs the nozzles to fire. The print data qualifying unit (1309) may confirm that the nozzle was instructed to fire. In some examples, the processor (1301) may send a measuring command without a preceding firing command to test the condition of the nozzle. In such situations, the print data qualifying unit (1309) would indicate the absence of a firing command.

The print data qualifying unit (1309) may be in communication with a nozzle health repositories (1310, 1311, 1312), which may make a final determination on the specific condition of the predetermined nozzle (1303) taking into account the information from the time repositories (1308) and the print data qualifying unit (1309).

In some examples, the processor (1301) initiates a remedial action upon determining an issue with the nozzle (1303). The remedial action may include instructing a second nozzle (1314) to compensate for nozzle (1303).

Figure 14:
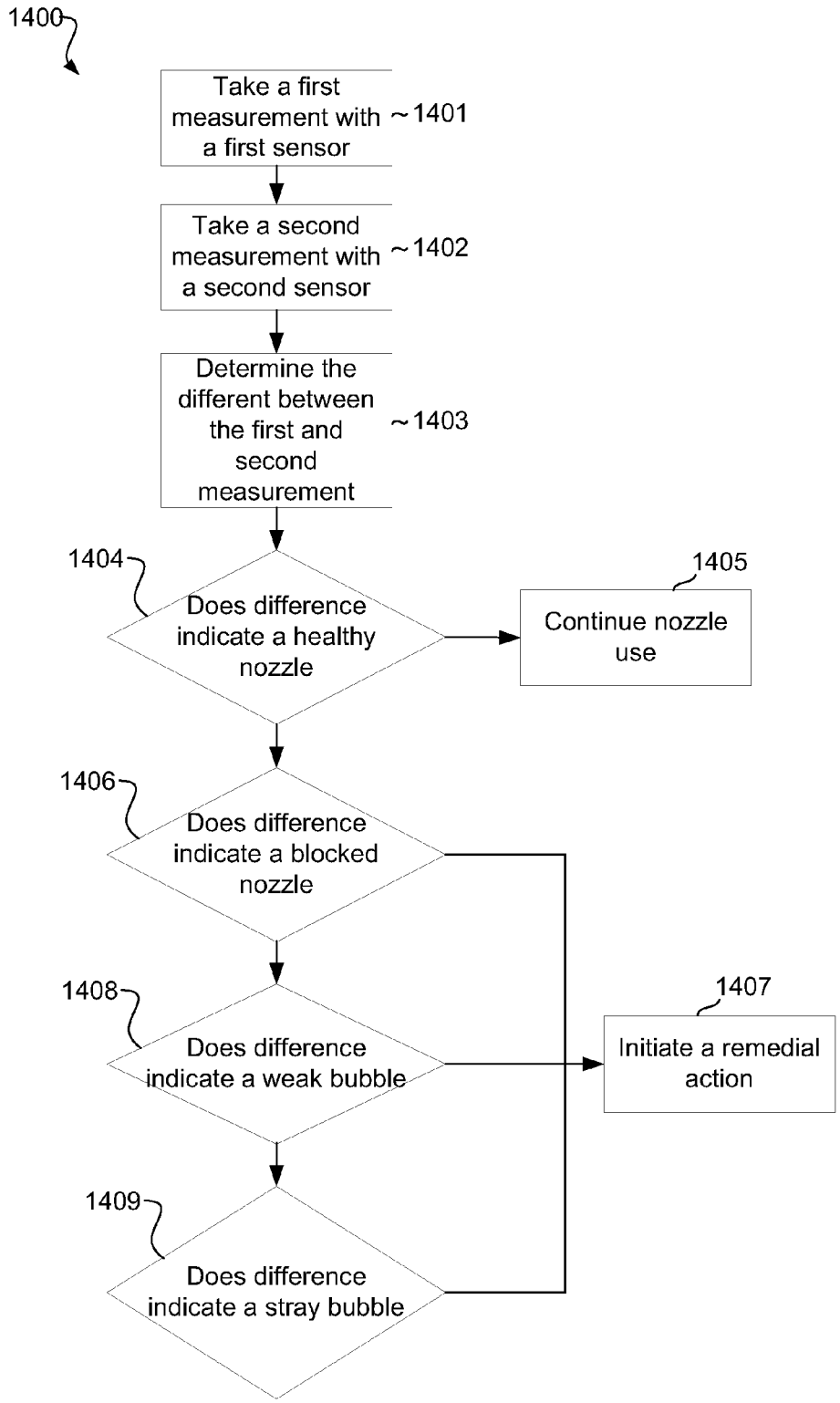
FIG. 14 is a diagram of an illustrative flowchart of a method for determining an issue, according to principles described herein.

FIG. 14 is a diagram of an illustrative flowchart of a method (1400) for determining an issue with an inkjet nozzle, according to principles described herein. In this example, the method (1400) includes taking (1401) a first measurement with a first sensor and taking (1402) a second measurement with a second sensor. The method (1400) may also include determining (1403) the difference between the first and the second measurement.

In the example of FIG. 14, the method also includes determining (1404) if the difference indicates that the nozzle is healthy. If the determination is that the nozzle is healthy, then the nozzle is continued (1405) to be used. On the other hand, if the difference indicates that the nozzle is not healthy, then a determination (1406) is made on whether the difference indicates a block nozzle. If the difference indicates that there is a blocked nozzle, then an appropriate remedial action is initiated (1407).

If the determination (1406) does not indicate a blocked nozzle, then another determination (1408) is made on whether the difference indicates the formation of weak drive bubble. If the determination (1408) concludes that a weak drive bubble was formed, then an appropriate remedial action is initiated (1407).

If the determination (1408) does not indicate a weak bubble formation, then another determination (1409) is made on whether the difference indicates the presence of a stray bubble. If the determination (1409) concludes that there is a presence of a stray bubble, then an appropriate remedial action is initiated (1407).

If the determination (1409) fails to conclude that there is a stray bubble, then another determination may be made about whether another issue exists. This procedure may continue until an issue type is indentified. In situations, where no issue type is found, the method (1400) may be repeated until the issue type is determined. However, in some examples, if no issue type is determined the system determines that there is an error in the sensing circuitry.

Figure 15:
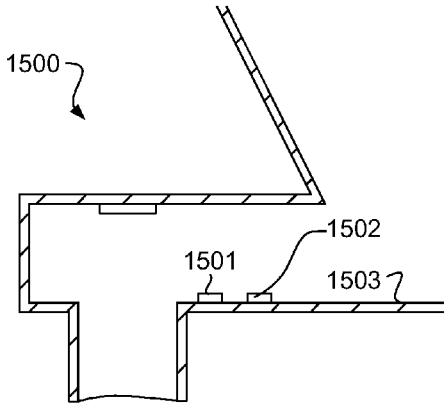
FIG. 15 is a cross sectional diagram of an illustrative ink chamber, according to principles described herein.

FIG. 15 is a cross sectional diagram of an illustrative ink chamber (1500), according to principles described herein. In this example, the ink chamber (1500) includes a first sensor plate (1501) and a second sensor plate (1502) located on a floor (1503) of the ink chamber (1500). The difference in the measurements from the first and second sensors (1501, 1502) may be used to determine the health of the nozzle.

In alternative examples, the first sensor is positioned on the ceiling of the ink chamber while the second sensor is positioned on the floor of the ink chamber. Further, in some examples, the first and the second sensors are placed in different locations throughout the ink chamber and/or ink reservoir that are capable of detecting the presence of a drive bubble.

Figure 16:
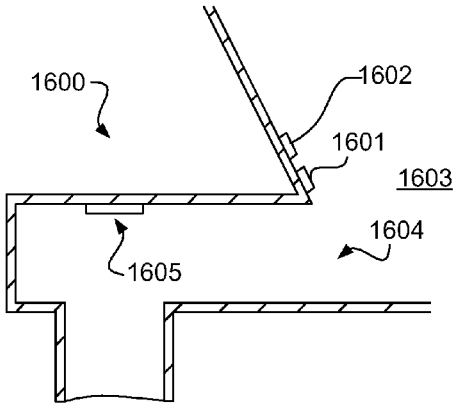
FIG. 16 is a cross sectional diagram of an illustrative ink chamber, according to principles described herein.

FIG. 16 is a cross sectional diagram of an illustrative ink chamber (1600), according to principles described herein. In this example, the first sensor (1601) and the second sensor (1602) are located in an ink reservoir (1603) in fluid communication with the ink chamber (1600) through an inlet (1604). In this example, both the first and the second sensors (1601, 1602) are positioned to detect the presence of a drive bubble in the ink chamber (1600) because the drive bubble expands from the bubble's initiation point (1605) within the ink chamber (1600) into the ink reservoir (1603). As a consequence, the detection of a drive bubble in the ink reservoir (1603) also indicates the presence of the drive bubble within the ink chamber (1600). In alternative examples, a first sensor is positioned within the ink chamber and the second sensor may be positioned within the ink reservoir.

Figure 17:
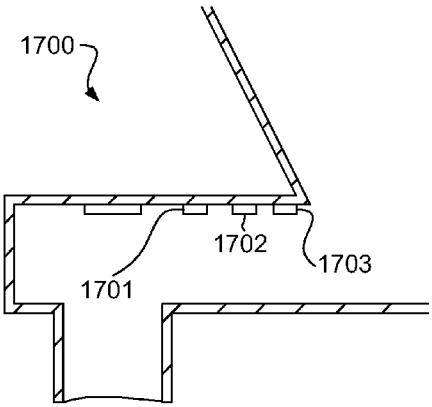
FIG. 17 is a cross sectional diagram of an illustrative ink chamber, according to principles described herein.

FIG. 17 is a cross sectional diagram of an illustrative ink chamber (1700), according to principles described herein. In this example, the ink chamber has a first sensor (1701), a second sensor (1702), and a third sensor (1703) positioned to detect the presence of a drive bubble. In some examples, the difference between the measurement of the first sensor (1701) and the measurement of the second sensor (1702) are used to determine the condition of the nozzle. In other examples, the difference between the measurement of the second sensor (1702) and the measurement of the third sensor (1703) are used to determine the condition of the nozzle. In some examples, any number of sensors in any position to detect the presence of a drive bubble may be used. Any difference between any two of the sensors may be used to determine the nozzle's condition. In some examples, differentials measurements of three or more sensors are used to determine the condition of the nozzles.

Figure 18:
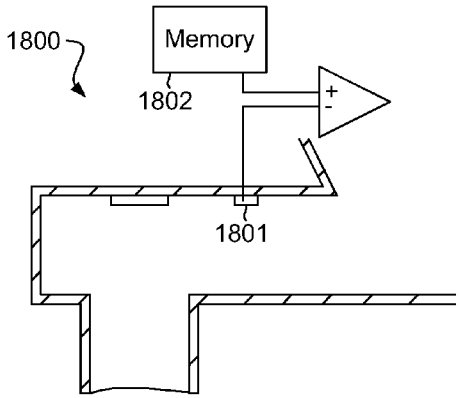
FIG. 18 is a cross sectional diagram of an illustrative ink chamber, according to principles described herein.

FIG. 18 is a cross sectional diagram of an illustrative ink chamber (1800), according to principles described herein. In this example, a single sensor (1801) is positioned to detect the presence of the drive bubble within the ink chamber (1800). The sensor (1801) may take a measurement and compare its impedance value to a reference stored in memory (1802). The reference may be an impedance value taken at substantially the same time duration from firing the drive bubble formation mechanism that may have either been measured earlier by the sensor (1801) or measured in a second ink chamber. In some examples where the reference is derived from a measurement from another ink chamber, the measurement in the second ink chamber may occur at substantially the same time as the measurement in ink chamber (1800) or the measurement in the second ink chamber may have been taken earlier.

While the principles herein have been described with a specific number of measurements, any number of measurements may be taken to determine the health condition of a nozzle. Also, while the principles herein have been described herein with a specific number of sensors, any number sensors may be used. Further, any number of measurement differential may be used to determine the existence of an issue and/or type of issue.

While the principles herein have been described with specific ink chamber geometries, drive bubble formation mechanism placements, and sensor placements, any placement of components within the ink chamber and any geometry of the ink chamber are included within the scope of the principles described herein.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A method for determining an issue with an inkjet nozzle using an impedance difference, the method comprising:

taking a first impedance measurement with a sensor to detect a drive bubble in an ink chamber after a drive bubble formation mechanism is activated, said sensor being positioned to be in physical contact with ink in said ink chamber prior to formation of said drive bubble and to be in physical contact with said drive bubble, when formed, the sensor to detect said drive bubble in said ink chamber by detecting a change in impedance produced by said drive bubble contacting said sensor and thereby decreasing contact between said ink and said sensor; and detecting said change in impedance by subtracting said first impedance measurement from a reference.

2. The method of claim 1, wherein said reference is an impedance value stored in memory.

3. The method of claim 1, wherein said reference is an impedance value derived from a second measurement taken with a second sensor and taken at substantially a same time as said first impedance measurement.

4. The method of claim 1, wherein said reference is an impedance value derived from an earlier measurement taken with said sensor and taken earlier than said first impedance measurement.

5. The method of claim 1, wherein said reference is an impedance value derived from a second measurement taken with a second sensor to detect a second drive bubble in a second ink chamber.

6. The method of claim 1, further comprising taking a second impedance measurement with a second sensor in said ink chamber at substantially a same time as said first impedance measurement; and subtracting said second measurement from said reference.

7. The method of claim 1, further comprising determining said issue exists based on a difference between said first impedance measurement and said reference.

8. The method of claim 7, further comprising compensating for said issue with a second inkjet nozzle.

9. The method of claim 1, wherein said issue is a blocked nozzle passage, a weak bubble formation, presence of a stray bubble, blocked ink chamber inlet, or combinations thereof.

10. An ink jet print head, comprising, a first ink chamber comprising a drive bubble formation mechanism and multiple impedance sensors positioned at different locations in the first ink chamber to detect a presence of a drive bubble in said first ink chamber, each sensor detecting a change in impedance caused by a drive bubble decreasing physical contact between the sensor and ink of the first ink chamber; and each impedance sensor being in communication with a processor programmed to determine a difference between an impedance measurement taken with one of said impedance sensors and an impedance reference value.

11. The print head of claim 10, wherein a first impedance sensor is positioned on a floor of the first ink chamber and a second impedance sensor is positioned on a ceiling in said first ink chamber.

12. The print head of claim 10, wherein said processor is in communication with a second ink chamber in said print head.

13. The print head of claim 12, wherein said processor is programmed to instruct components within said second ink chamber to compensate for said first ink chamber when said processor determines that said first ink chamber has an issue based off of said difference between said impedance measurement and said impedance reference value.

14. A printer, comprising, a plurality of ink chambers each comprising a drive bubble formation mechanism and a first impedance sensor and a second impedance sensor positioned to detect a presence of a bubble in a respective ink chamber; and said first and second impedance sensors each being in communication with a differential amplifier programmed to determine a difference between a first impedance measurement taken with said first impedance sensor and a second impedance measurement taken with said second impedance sensor.

15. The printer of claim 14, wherein said differential amplifier is in communication with logic programmed to determine if an issue exists in said ink chamber based on of said difference between said first impedance measurement said second impedance measurement.

16. The printer of claim 15, further comprising a plurality of processors, wherein said processors are programmed, upon determination that said issue exists, to further determine if a remedial action should be taken.

17. The printer of claim 16, wherein said remedial action comprises compensating for said issue, notification of said issue, disabling of said bubble formation mechanism, or combinations thereof.

18. The printer of claim 15, wherein said difference is used to determine what type of said issue exists.

19. The printer of claim 15, wherein said type of said issue is determined to be a blocked nozzle passage, a weak bubble formation, presence of a stray bubble, blocked ink chamber inlet, or combinations thereof.

* * * * *

UNITED STATES PATENT AND TRADEMARK OFFICE

CERTIFICATE OF CORRECTION

PATENT NO. : 8,899,709 B2
APPLICATION NO. : 13/450620
DATED : December 2, 2014
INVENTOR(S) : Alexander Govyadinov et al.

It is certified that error appears in the above-identified patent and that said Letters Patent is hereby corrected as shown below:

In the Drawings

Fig. 14, in sheet 7 of 8, reference numeral 1403, line 2, delete "different" and insert -- difference --, therefor.

Signed and Sealed this
Second Day of June, 2015

Michelle K. Lee

Michelle K. Lee
*Director of the United States Patent and Trademark Office*